United States Patent [19]

Smart

[11] 3,980,205

[45] Sept. 14, 1976

[54] AEROSOL CAN DISCHARGING APPARATUS

[75] Inventor: Robert Keith Smart, Sydney, Australia

[73] Assignee: Qantas Airways Limited, Queensland, Australia

[22] Filed: Mar. 20, 1975

[21] Appl. No.: 560,353

[52] U.S. Cl. ..... 222/70

[51] Int. Cl.[2] ..... G04C 23/04

[58] Field of Search ..... 222/63, 76, 135, 136, 222/485, 70, 509, 506, 5, 86, 88; 251/90, 92

[56] References Cited

UNITED STATES PATENTS

| | | | |
|---|---|---|---|
| 2,971,382 | 2/1961 | Harris | 222/70 X |
| 3,018,056 | 1/1962 | Montgomery | 222/70 X |
| 3,286,883 | 11/1966 | Takiff | 222/509 X |
| 3,411,670 | 11/1968 | Mangel | 222/70 |
| 3,575,319 | 4/1971 | Safianoff | 222/135 |
| 3,598,288 | 8/1971 | Porgate | 222/70 |
| 3,643,836 | 2/1972 | Hunt | 222/70 |
| 3,647,116 | 3/1972 | Nixon, Jr. | 222/70 |
| 3,677,441 | 7/1972 | Nixon, Jr. | 222/135 X |

*Primary Examiner*—Allen N. Knowles
*Assistant Examiner*—Norman L. Stack, Jr.
*Attorney, Agent, or Firm*—Howson and Howson

[57] ABSTRACT

The invention provides for automatically discharging aerosol cans and further includes the provision for controlling the time at which such discharge takes place.

10 Claims, 3 Drawing Figures

AEROSOL CAN DISCHARGING APPARATUS

The invention relates to apparatus for automatically discharging aerosol insecticide cans in aircraft and in particular to apparatus including means to control the time of discharge of aerosol cans.

World and Australian Health and Quarantine regulations governing the movement of aircraft require that certain sections of the aircraft which are normally sealed and/or inaccessible during flight such as the cabin and baggage compartment and their contents be fumigated before the aircraft is fully opened and contents are removed from the section once the aircraft has arrived at its destination.

Hitherto delays in the removal of baggage and baggage containers from aircraft have been experienced because in order to fumigate the aircraft's baggage compartments on landing, the door to the baggage compartment is opened and the insecticide or fumigant contained within an aerosol can is manually sprayed into the area of the baggage compartment adjacent the door. The door is then immediately closed for a period of approximately two minutes before the door is re-opened, the baggage adjacent the door is removed and the interior of the baggage compartment is given a further manual spray.

The baggage compartment door is then closed again for a period of ten minutes before the door is re-opened and the remainder of the baggage fully unloaded. This procedure results in lengthy delays in the delivery of airline passengers baggage to the customs halls especially where large numbers of passengers and a lot of baggage are involved.

The abovementioned disadvantages are overcome according to the present invention by aerosol can discharging apparatus comprising a timer and at least one plunger, said plunger being positioned above a corresponding aerosol can locating and supporting means and being movable between a first (retracted) position and an second (extended) position, wherein with said plunger in said first position an aerosol can is insertable within said locating and supporting means, thereby positioning the operating button at the top of said aerosol can in proximity to said plunger, and the movement of said plunger from said first to said second position to depress said button and discharge said aerosol can is controlled by said timer.

The apparatus of the present invention may typically be installed in the baggage compartment(s) of an aircraft and manually loaded with one or more cans of aerosol insecticide before the door to the baggage compartment is closed prior to departure. The timer is set to discharge the contents of the can(s) after the baggage compartment doors have been closed. The discharge may be timed or converted to the aircraft system to take place at any time before the aircraft lands at its destination.

One embodiment of the present invention will now be described with reference to the drawings. The preferred apparatus is able to simultaneously discharge two aerosol cans, however, clearly the apparatus may be modified to discharge a single can or to simultaneously or sequentially discharge a multiplicity of cans.

Figure 1:
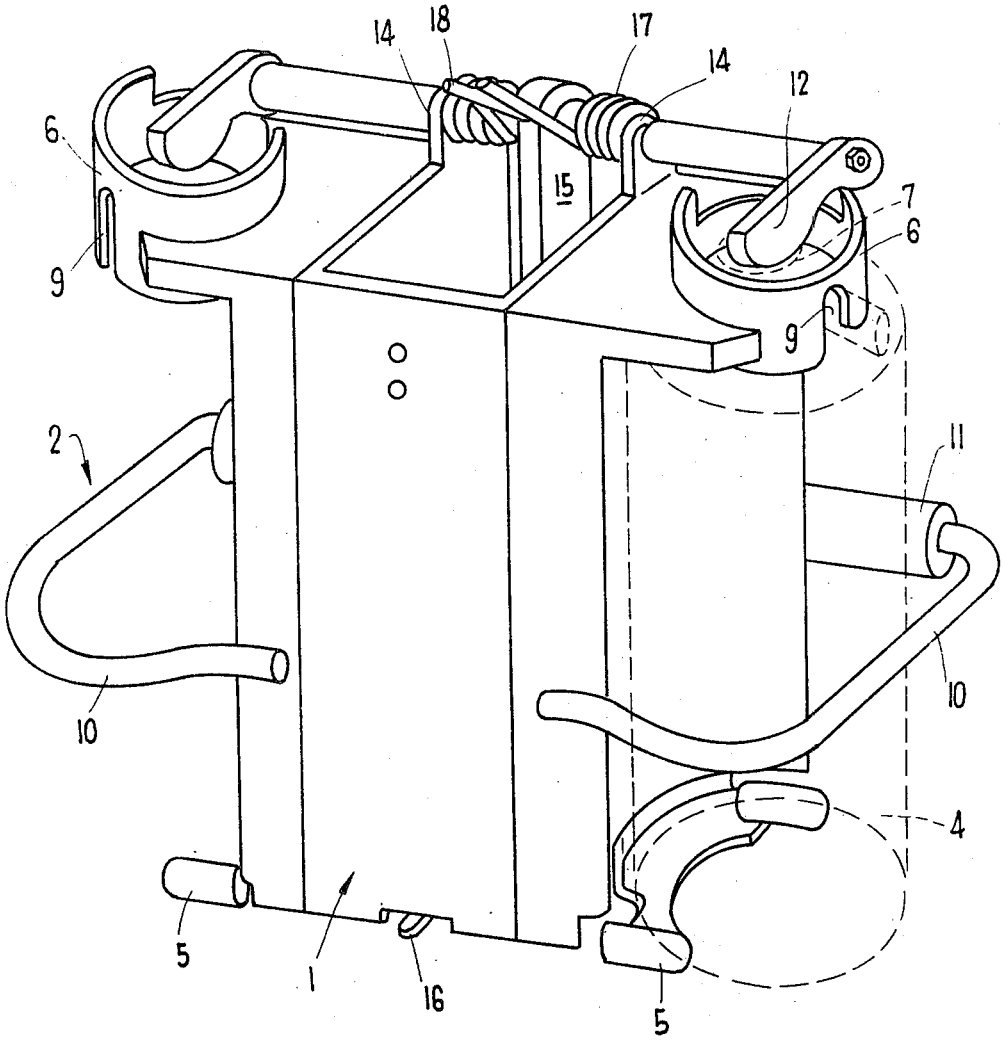
FIG. 1 shows a front perspective view of the apparatus with a single can positioned therein.

The apparatus comprises a central body 1 having a can locating and supporting means 2 positioned one to each side thereof. Each can locating and supporting means 2 comprises a shaped wall portion 3 of the central body 1 which is adapted to receive the cylindrical surface of an aerosol can 4, a pair of can supporting lugs 5 and an operating button housing 6 which surrounds the operating button 7 of the aerosol can 4. The nozzle 8 of the aerosol can 4 is positioned in the desired direction by an opening 9 in the operating button housing 6.

Figure 2:
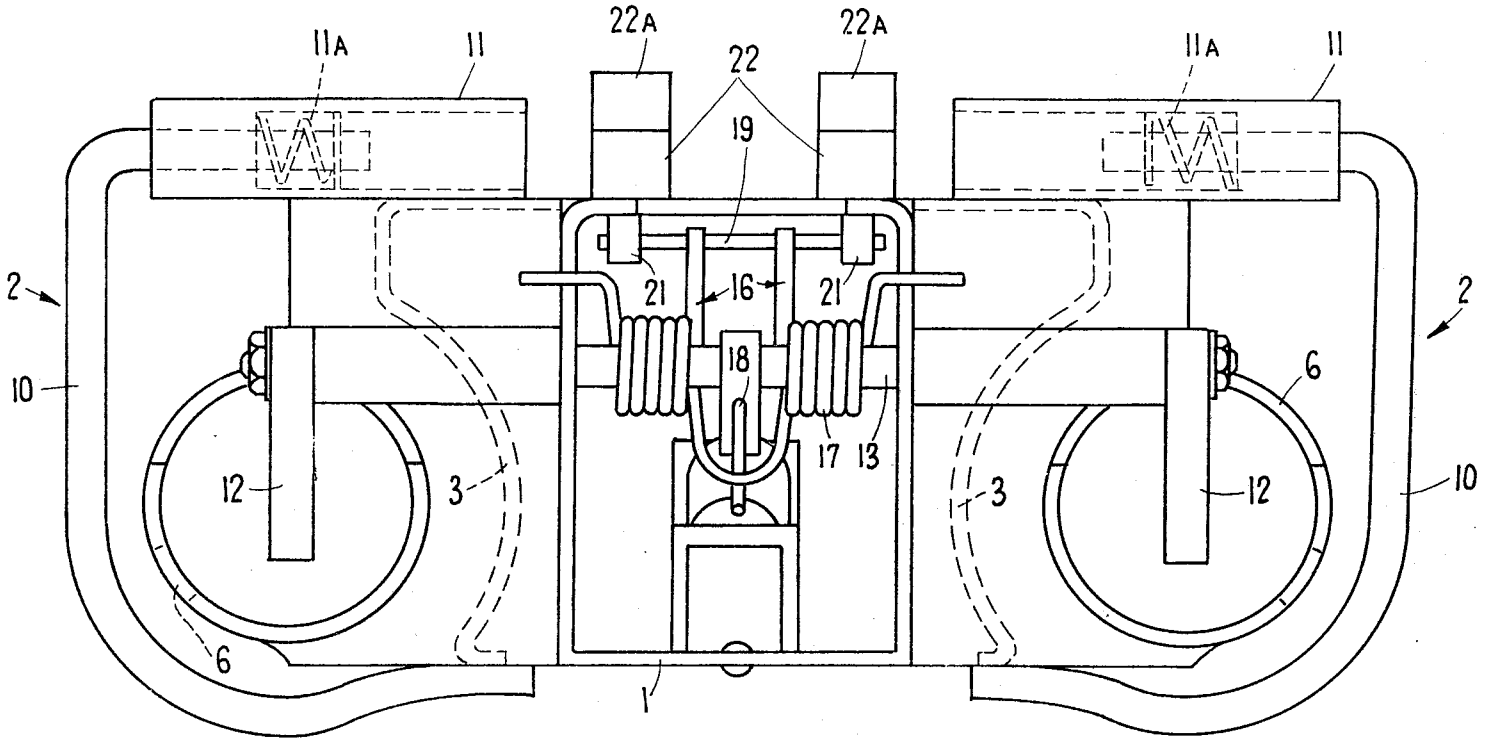
FIG. 2 shows a plan view of the top of the apparatus without any cans being positioned therein.

The aerosol can 4 is held in position by a clamping arm 10 which is slidably mounted in a tube 11. The clamping arm 10 is biassed by spring 11A (FIG. 2) which urges the clamping arm 10 towards the central body 1 thereby holding the aerosol can against the shaped wall portion 3 of the central body 1.

In order to insert the aersol can 4 into the can locating and supporting means 2, the clamping arm 10 is manually moved away from the central body 1 against the action of spring 11A, the operating button 7 of the aerosol can 4 is passed between the can supporting lugs 5 and the clamping arm 10 and into the operating button housing 6. The base of the aerosol can 4 is then positioned on the can supporting lugs 5 and the clamping arm 10 released to secure the aerosol can 4 in position through the action of spring 11A. The aerosol can 4 may be removed from the apparatus by the reverse procedure.

The operating button 7 of each aerosol can 4 is able to be depressed, and the contents of the can 4 thereby emptied, by a plunger arm 12 secured one to each end of a shaft 13 pivotally mounted in brackets 14 located on the central body 1. The shaft 13 passes through and is secured to one end of a connecting rod 15. The connecting rod 15 passes through the centre of the central body 1 and has a substantially U-shaped indicator 16 pivotally mounted at the other end thereof. The shaft 13 is urged by tension spring 17 to rotate relative to the central body 1 in the direction shown in FIG. 3 by arrow A, the tension spring 17 being interposed between the central body 1 and a pin 18 secured to the connecting rod 15.

The U-shaped indicator 16 has an axle 19 located at one end thereof and a retaining link 20 at the other end thereof. A pair of rollers 21 are rotatably mounted one at each end of the axle 19. The rollers 21 each about a roller surface 22 formed on members 22A secured to the central body 1. A latching member 23 is pivotally mounted in the central body 1 and has a latch 24 at one end and triggering lever 25 at the other end. A return spring 26 abuts the latching member 23 adjacent the latch 24 and urges the latch 24 towards the indicator 16 and thereby urges the triggering lever 25 into abutment with a solenoid 27 mounted within the central body 1. The solenoid 27 has permeable armature 28 slidably mounted therein, energization of the solenoid 27 drawing the armature 28 further into the solenoid 27, contacting the triggering lever 25 and moving the latch 24 against the action of return spring 26.

Figure 3:
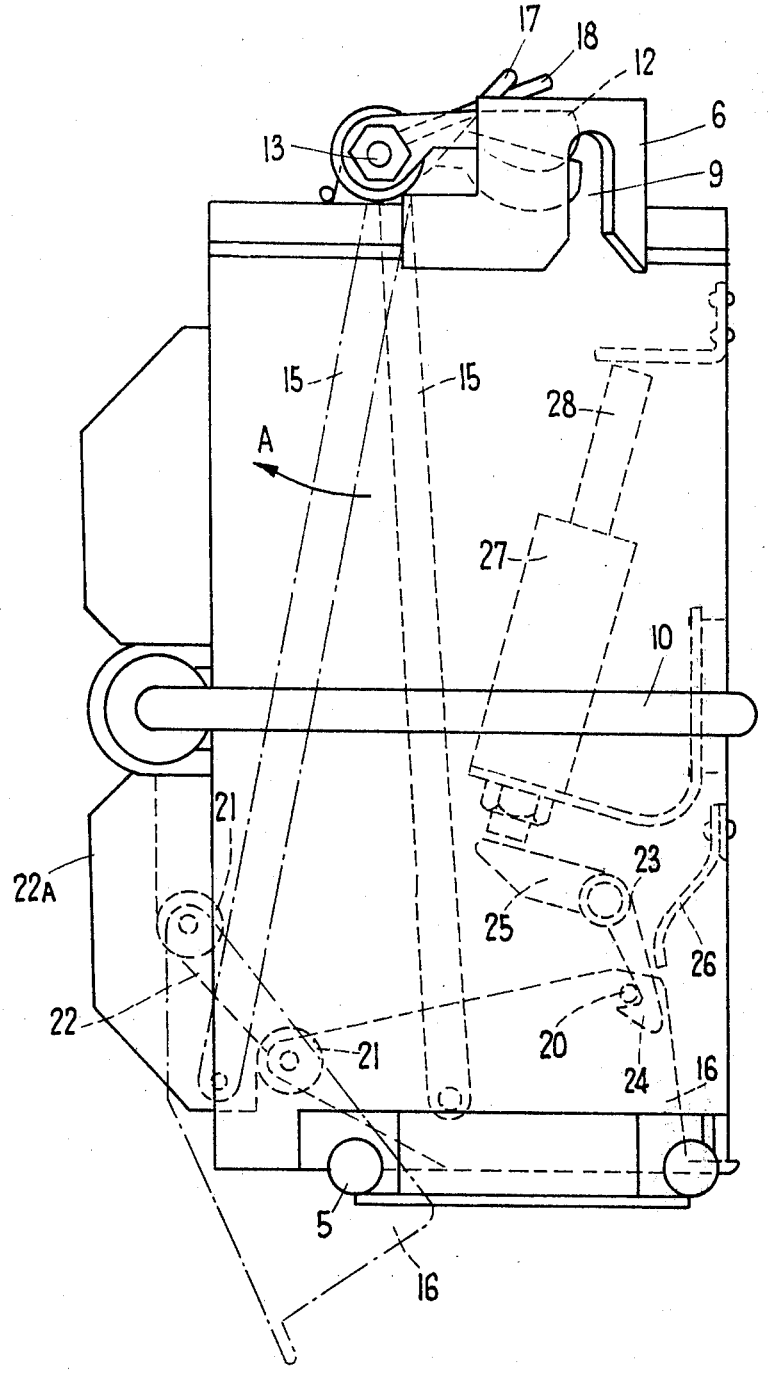
FIG. 3 shows an end view of the apparatus, some of the components being shown in broken outline.

In order to set the apparatus prior to use the indicator 16 is manually moved to the position indicated by the dashed lines in FIG. 3 against the action of tension spring 17 and retained in that position by engagement of latch 24 with retaining link 20. The abovementioned movement of indicator 16 moves the connecting rod 15 to the position indicated by the dashed lines in FIG. 3 thereby moving the plunger arms 12 in an anti-clockwise direction as seen in FIG. 3. With the plunger arms 12 retained in this position aerosol cans 4 may be inserted into the can locating and supporting means 2 and secured therein by clamping arms 10 as described above.

The apparatus is triggered by a conventional timer (not illustrated) which causes a current to flow in solenoid 27 thereby energizing solenoid 27, moving the armature 28 against the triggering lever 25, moving the latch 24 against return spring 26, disengaging the retaining link 20 from the latch 24 and thus allowing the indicator 16 and connecting rod 15 to move under the action of tension spring 17.

Thus when the apparatus is triggered, connecting rod 15 moves in the direction indicated by the arrow A in FIG. 3 and achieves the position indicated by the dot and dash lines in FIG. 3. As connecting rod 15 moves, rollers 21 of the indicator 16 roll over the roller surfaces 22 of the members 22A thereby pivoting indicator 16 in a clockwise direction as seen in FIG. 3 until the position indicated by dot and dash lines in FIG. 3 is achieved, at which position the indicator 16 is clear of the central body 1 and therefore is able to be easily seen.

The above described movement of the connecting rod 15 pivots shaft 13 in its bearings 14 and therefore moves plunger arms 12 in a clockwise direction as seen in FIG. 3 thereby depressing the operating button 7 of each aerosol can 4 and discharging its contents. The connecting rod 15 and indicator 16 remain in the position indicated by dot and dash lines in FIG. 3 until the apparatus is manually set again as described above. The timer need only supply a pulse of current to the solenoid 27 to momentarily energize the solenoid, since once latch 24 disengages retaining link 20 the indicator 16 moves freely under the action of tension spring 17. Return spring 26 moves the latching member 23 in a clockwise direction to regain the position indicated by dashed lines in FIG. 3. This movement of the indicator 16 provides an easy visual verification that the apparatus has functioned correctly and that the contents of the aerosol cans have been discharged as desired.

On arrival at the aircraft's destination the door to the baggage compartment is opened and the indicator 16 observed to confirm that the apparatus has been triggered. The indicator 16 is pushed into the retracted position thereby resetting the apparatus for use again. The discharged cans are then removed from the can locating and supporting means 2 and checked to see that they are empty.

The foregoing describes only one embodiment of the apparatus of the present invention and various modifications may be made thereto without departing from the scope of the invention. In particular the apparatus may be triggered either electrically, as shown, or mechanically depending upon the type of timer preferred. If desired the movement of the clamping arms 10 may be used to operate micro-switches incorporated in a control circuit and/or the timer to provide an indication at a remote position, such as the cockpit of an aircraft, that the apparatus has been loaded with new aerosol cans.

I claim:

1. Aerosol can discharging apparatus for simultaneously discharging the contents of two aerosol cans, said apparatus comprising a tubular body, aerosol can locating and supporting means to releasably secure an aerosol can alongside each of two opposed sides of said tubular body, a shaft rotatably mounted at one end of said tubular body substantially perpendicular to the longitudinal axis of said tubular body, and rotatable between a first and a second position, said shaft extending past each said opposing side, having a plunger arm secured at each end, and having an indicator arm connected thereto and passing through said tubular body, wherein said shaft is manually rotatable against biasing means into said first position to move said plunger arms clear of said aerosol can locating and supporting means, with said shaft in said first position two aerosol cans are releasably securable alongside said two opposed sides to position the operating button at the top of each aerosol can in proximity to the corresponding plunger arm, and said shaft is movable at a predetermined time from said first to said second position whereby said plunger arms depress said operating buttons to simultaneously discharge the contents of said aerosol cans and the altered position of said indicator arm caused by said movement of said shaft provides an easily observable indication of the position of said plunger arms.

2. The apparatus as claimed in claim 1 including latch means set by movement of said shaft into said first position to retain said shaft in said first position, said latch means being releasable at said predetermined time to permit said biasing means to rotate said shaft into said second position.

3. Aerosol can discharging apparatus comprising a plunger arm, said plunger arm being secured at one end to a rotatably mounted shaft positioned above aerosol can locating and supporting means, and being rotatable with said shaft between said first (retracted) position and a second (extended) position, wherein said shaft is rotatable to locate said plunger arm in said first position, compress resilient means and set latch means to retain said plunger arm in said first position, and wherein with said plunger arm in said first position an aerosol can is insertable within said locating and supporting means thereby positioning the operating button at the top of said aerosol can in proximity to the other end of said plunger arm, and said set latch means is releasable at a predetermined time to permit said resilient means to rotate said shaft and thereby move said plunger from said first to said second position to depress said button by said other plunger arm end and discharge said aerosol can.

4. The apparatus as claimed in claim 3 wherein said resilient means is a spring and said latch means includes a solenoid having an armature, said solenoid being energizable at said predetermined time to release said set latch means.

5. The apparatus as claimed in claim 3 including an indicator operatively associated with said shaft and movable therewith, said indicator providing an easily observable indication of the position of said plunger arm.

6. The apparatus as claimed in claim 3 wherein said locating and supporting means includes a housing for the operating button of said aerosol can, said housing including means to locate the nozzle of the aerosol can thereby determining the direction, relative to said apparatus, in which the contents of said aerosol can are discharged.

7. Aerosol can discharging apparatus for simultaneously discharging the contents of two or more aerosol cans, said apparatus comprising a timer and at least two plungers, said plungers each being positioned above a corresponding aerosol can locating and supporting means and being movable between a first (retracted) position and a second (extended) position, wherein each said plunger is secured to a rotatably mounted shaft manually rotatable against resilient means to move said plungers to said first position, to compress said resilient means and to set latch means to retain said plunger in said first position, and wherein with said plungers in said first position an aerosol can is insertable within each said locating and supporting means, thereby positioning the operating button at the top of each aerosol can in proximity to the corresponding plunger, the movement of said plunger from said first to said second position to depress said button and discharge said aerosol can is controlled by said set latch means being released by said timer and said plungers are moved to said second position by said resilient means.

8. The apparatus as claimed in claim 7 wherein said latch means includes a solenoid having an armature, said solenoid energizable by said timer to move said armature and release said set latch means.

9. The apparatus as claimed in claim 7, wherein said resilient means comprises a spring.

10. The apparatus as claimed in claim 7 including an indicator operatively associated with said shaft and movable therewith, said indicator providing an easily observable indication of the position of said plungers.

* * * * *